US008247983B2

(12) United States Patent
Song et al.

(10) Patent No.: US 8,247,983 B2
(45) Date of Patent: Aug. 21, 2012

(54) LAMP DRIVING CIRCUIT

(75) Inventors: Zhihua Song, Shanghai (CN); Paul Robert Veldman, Oss (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 348 days.

(21) Appl. No.: 12/671,724

(22) PCT Filed: Jul. 28, 2008

(86) PCT No.: PCT/IB2008/053015

§ 371 (c)(1),
(2), (4) Date: Feb. 2, 2010

(87) PCT Pub. No.: WO2009/019624

PCT Pub. Date: Feb. 12, 2009

(65) Prior Publication Data

US 2011/0234112 A1 Sep. 29, 2011

(30) Foreign Application Priority Data

Aug. 9, 2007 (CN) ..... 2007 1 0141400

(51) Int. Cl.
*H05B 37/00* (2006.01)

(52) U.S. Cl. ..... 315/219; 315/277; 315/279

(58) Field of Classification Search ..... 315/276, 315/277, 279, 282, 224, 219, DIG. 2, DIG. 5
See application file for complete search history.

(56) References Cited

U.S. PATENT DOCUMENTS

| | | | | |
|---|---|---|---|---|
| 6,717,371 | B2 | 4/2004 | Klier et al. | |
| 7,061,183 | B1 | 6/2006 | Ball | |
| 7,567,039 | B2 * | 7/2009 | Shinmen et al. | 315/224 |
| 7,667,410 | B2 * | 2/2010 | Kim et al. | 315/274 |
| 2002/0140372 | A1 | 10/2002 | Langeslag et al. | |
| 2003/0214252 | A1 | 11/2003 | Klien et al. | |
| 2005/0093472 | A1 | 5/2005 | Jin | |
| 2006/0119293 | A1 | 6/2006 | Chan et al. | |
| 2006/0175981 | A1 | 8/2006 | Hsueh et al. | |
| 2007/0007908 | A1 | 1/2007 | Kim et al. | |
| 2007/0007909 | A1 | 1/2007 | Kim et al. | |
| 2007/0152599 | A1 | 7/2007 | Chan et al. | |

FOREIGN PATENT DOCUMENTS

| | | | |
|---|---|---|---|
| DE | 102005001326 | A1 | 7/2006 |
| EP | 1615477 | A2 | 1/2006 |

* cited by examiner

*Primary Examiner* — David Hung Vu
(74) *Attorney, Agent, or Firm* — Mark L. Beloborodov

(57) ABSTRACT

The present invention provides a lamp driving circuit. When it is used to drive a number of lamps arranged in a hybrid serial-parallel configuration, the lamp driving circuit eliminates the parasitic current in series branch circuits by using an inverse transformer, which makes the current passing each of the lamps in each of the series branch circuits consistent and consequently eliminates the imbalance of each of the lamps.

14 Claims, 5 Drawing Sheets

LAMP DRIVING CIRCUIT

FIELD OF THE INVENTION

This invention relates to lighting technology, in particular, to a lamp driving circuit for an electronic ballast.

BACKGROUND OF THE INVENTION

When an electronic ballast is used to drive more than one lamp, two types of circuit connections, i.e. series lamp circuit and parallel lamp circuit, are usually employed to connect the lamps. The parallel lamp circuits are widely used together with dimmable ballasts, with which the lamps may be dimmed. The main defects of parallel lamp circuits are that greater amounts of lamp currents pass through lamp inductors and an extra equalizer transformer is needed in the circuit. In practice, when a parallel lamp circuit is used for a dimmable ballast of more than one lamp, these defects may limit the application of the parallel lamp circuits.

A hybrid series-parallel lamp circuit is proposed to replace a purely parallel lamp circuit. FIG. 1 shows a schematic view of the circuit structure of a hybrid series-parallel lamp circuit for driving four lamps, where lamp 1 and lamp 2 are connected in series into a branch circuit, lamp 3 and lamp 4 are connected in series into another branch circuit, and these two branch circuits are connected in parallel. T2_1 and T2_2 are two windings of an equalizer transformer T2. An inductor Lr is connected to a high-frequency half-bridge circuit of an electronic ballast, which is not a critical part of the present invention and thus, not shown in the figures. Those two serially connected lamps are electrically asymmetric with respect to ground, The high frequency voltages of lamp 2 and lamp 4 drop at node 1 and node 2, respectively, forming hot points with respect to ground. Parasitic capacitive current Ipa passes parasitic capacitor Cpa, forming an AC path, as shown by dotted lines in FIG. 2, causing the amount of current passing lamp 1 and lamp 3 to be greater than that passing lamp 2 and lamp 4. From the point of view of vision, lamp 1 and lamp 3 are brighter than lamp 2 and lamp 4, in particular, when they are dimmed to below normal level, the difference in brightness will become more and more obvious, and finally, reach an extent that is unacceptable to users.

Another drawback of such a hybrid series-parallel lamp circuit is that, as shown in FIG. 3, when only three lamps are connected in the circuit, and account being taken of the fact that the voltages of the two branch circuits need to be balanced by the equalizer transformer T2, half of the lamp voltage in each branch circuit will drop on T2, causing the cold points in the circuit, i.e. the locations of node 3 and node 4 in FIG. 3, to be transformed to hot points and carry the high-frequency voltage of T2 and consequently, the parasitic capacitive current flows to ground. The current IT2_1 shown in FIG. 3 is equal to the vector sum of the lamp current Ila2 and the parasitic current Ipa, while the current IT2_2 is equal to the vector sum of the lamp current Ila3 and the parasitic current Ipa. Since there is a phase difference of 180° between the voltages of node 3 and node 4, the currents passing the two windings of the T2 are different. Although the current IT2_1 and IT2_2 are made as equal as possible through the equalizer transformer T2, the result of this balancing is not desirable, as T2 does not know the real current of the lamp, resulting eventually in different lamp currents Ila2 and Ila. Furthermore, also due to the existence of the parasitic current Ipa, the lamp current Ila1 is different from the lamp current Ila2; this is similar to the case of four lamps of FIG. 2.

SUMMARY OF THE INVENTION

The objective of this invention is to provide a lamp driving circuit, which eliminates the imbalance through adding an inverse transformer, for driving a number of lamps. This object is achieved by a lamp driving circuit according to the present invention for driving more than one lamp, wherein the more than one lamps are located on at least two branch circuits connected in parallel, the lamp driving circuit comprising:

a first transformer comprising at least two windings, which are connected in series to the at least two branch circuits connected in parallel; and an inverse means connected to the at least two branch circuits connected in parallel, for eliminating the AC voltage of the lamps with respect to ground to balance the current of each lamp.

According to another solution of a lamp driving circuit according to the present invention, the inverse means comprises a second transformer, the second transformer comprising a first winding connected in parallel to the at least two branch circuits connected in parallel and a second winding connected in series to the at least two branch circuits connected in parallel.

Compared with the prior art, the lamp driving circuit of the present invention eliminates the parasitic current in the series branch circuits by using the inverse transformer, and keeps the current passing through each lamp in the series branch circuits consistent and consequently, eliminates the imbalance of the lamps.

Other objectives and effects of the present invention will be clearer and easier to understand through the description with reference to the accompanying drawings and the description of the claims.

BRIEF DESCRIPTION OF THE DRAWINGS

The present invention will be described in more detail with reference to the accompanying drawings, in which.

DETAILED DESCRIPTION OF THE INVENTION

Figure 4:
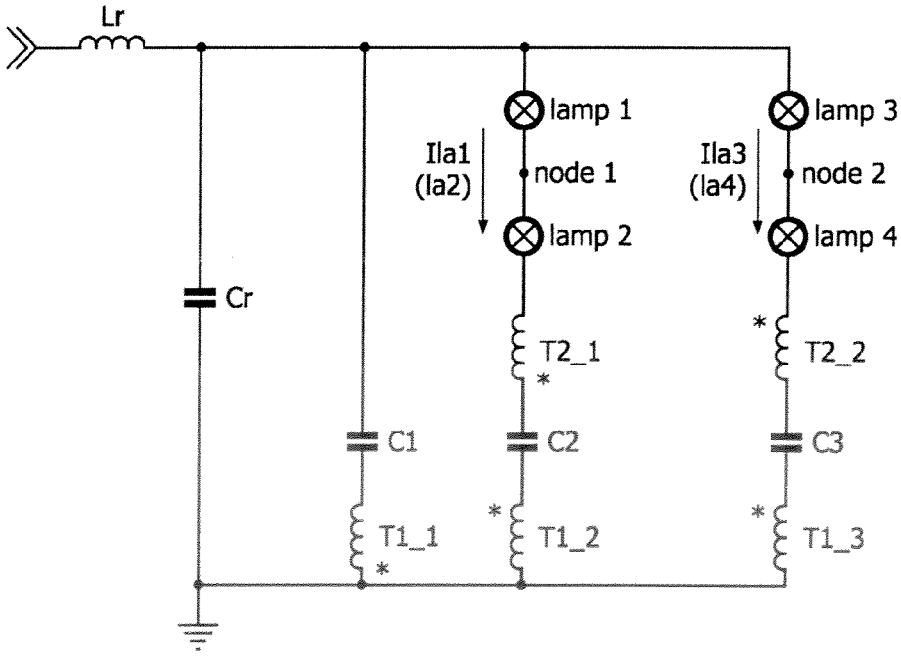
FIG. 4 shows a schematic view of an embodiment of a hybrid series-parallel lamp circuit for driving four lamps according to this invention.

An embodiment of the driving circuit of the present invention is shown in FIG. 4. Compared with the prior arts, besides the equalizer transformer T2, an inverse transformer T1 is introduced in this embodiment. The voltage of each winding of T1 is identical to that of a lamp, but there is a phase difference of 180°. The inverse effect brought about by the inverse transformer T1 may eliminate the AC voltage of the nodes 1 and 2 with respect to ground, i.e. make the AC voltage at the nodes 1 and 2 zero. As a result, two sets of series lamps are electrically balanced, and there is no parasitic current flowing from node 1 to the node 2, thus causing the current Ila1 (la2) passing lamp 1 and lamp 2 to be identical, while the current Ila3 (la4) passing lamp 3 and lamp 4 is identical as well.

Figure 5:
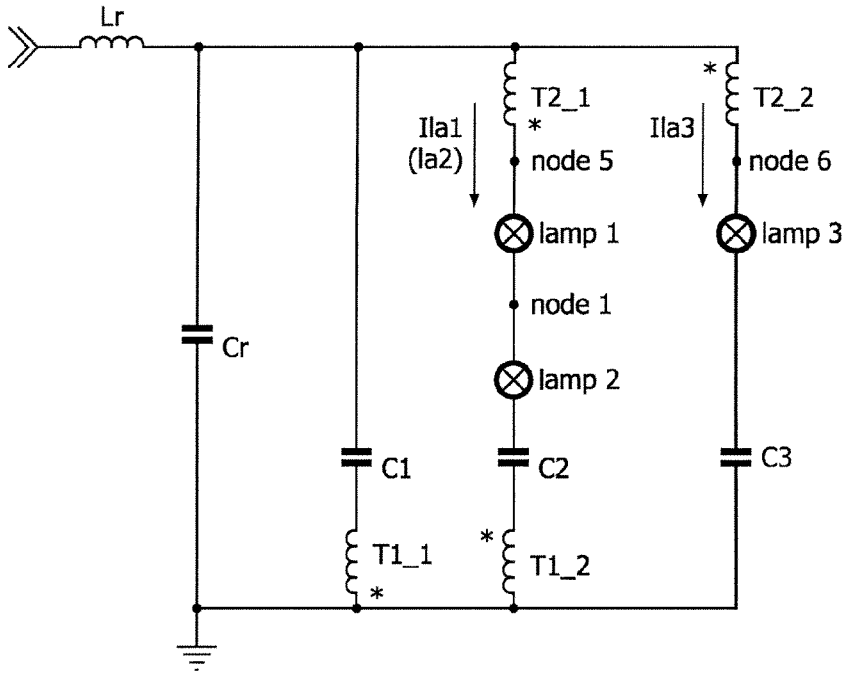
FIG. 5 shows a schematic view of an embodiment of a hybrid series-parallel lamp circuit for driving three lamps according to the present invention.

When only three lamps are connected to the circuit, the inverse transformer T1 may further be simplified to comprise only two windings, the detailed circuit structure of which is shown in FIG. 5. Similarly to the case of four lamps, the inverse transformer T1 may eliminate the AC voltage of node 1 with respect to ground, meanwhile, the winding T1_2 of T1 may replace the equalizer transformer T2 to compensate for the imbalanced lamp voltage in the two branch circuits. Under ideal conditions, when the impedance values of three lamps are identical, the voltage of T2 is zero. As nodes 5 and 6 have identical AC voltages with respect to ground, T2 is connected between the inductor Lr and nodes 5 and 6 to be able to obtain an appropriate balancing effect. The circuit shown in FIG. 5 may likewise make sure that identical currents pass through each lamp.

Figure 6:
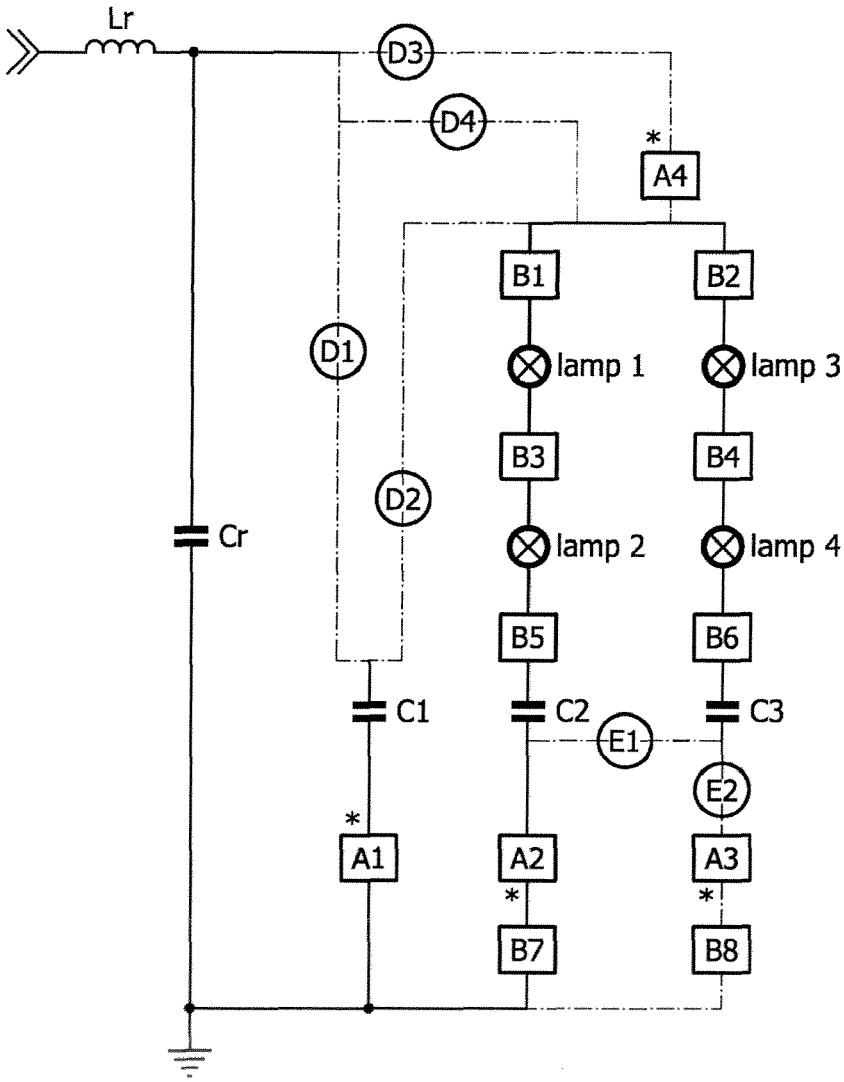
FIG. 6 shows a general structure of a hybrid series-parallel lamp circuit for driving four lamps according to the present invention.

In practice, the inverse transformer T1 and the equalizer transformer T2 may be connected in many other ways depending upon the various needs. FIG. 6 shows some possibilities of connection of T2 when four lamps are connected, wherein D1-D4 and E1, E2 represent different possibilities of circuit connections, A1-A4 represent the locations of different windings of the inverse transformer T1, and B1-B8 represent the locations of different windings of the equalizer transformer T2, and various combinations of such elements may form various lamp driving circuits.

Figure 1:
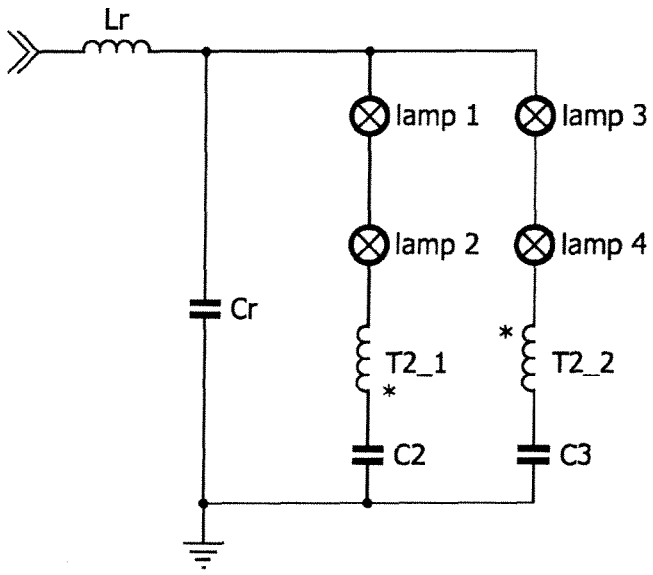
FIG. 1 PRIOR ART
FIG. 1 shows a schematic view of a hybrid series-parallel lamp circuit of a prior art for driving four lamps.
Figure 2:
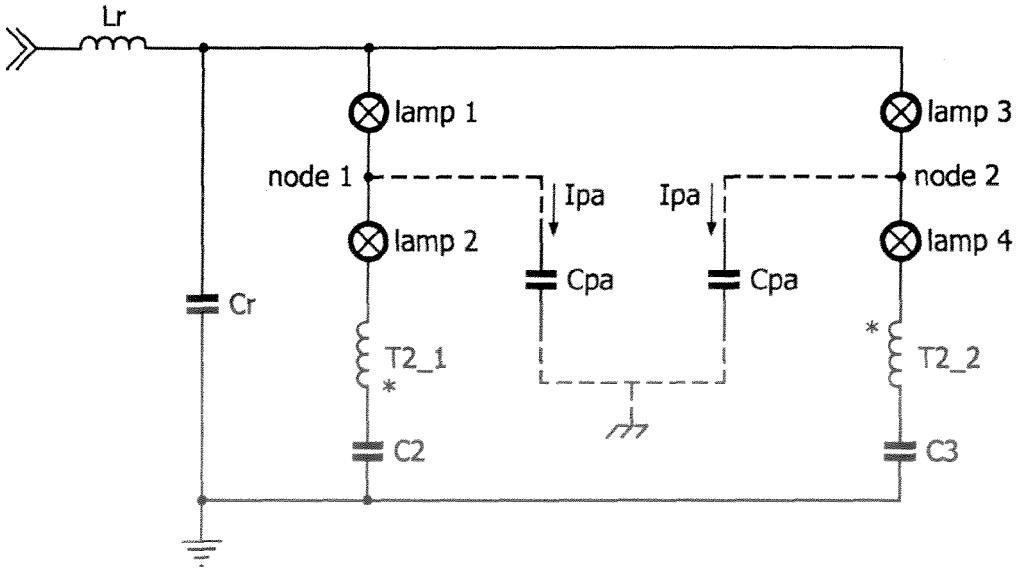
FIG. 2 PRIOR ART
FIG. 2 shows the hybrid series-parallel lamp circuit of FIG. 1 and a schematic view of some parasitic circuits in the hybrid series-parallel lamp circuit.
Figure 3:
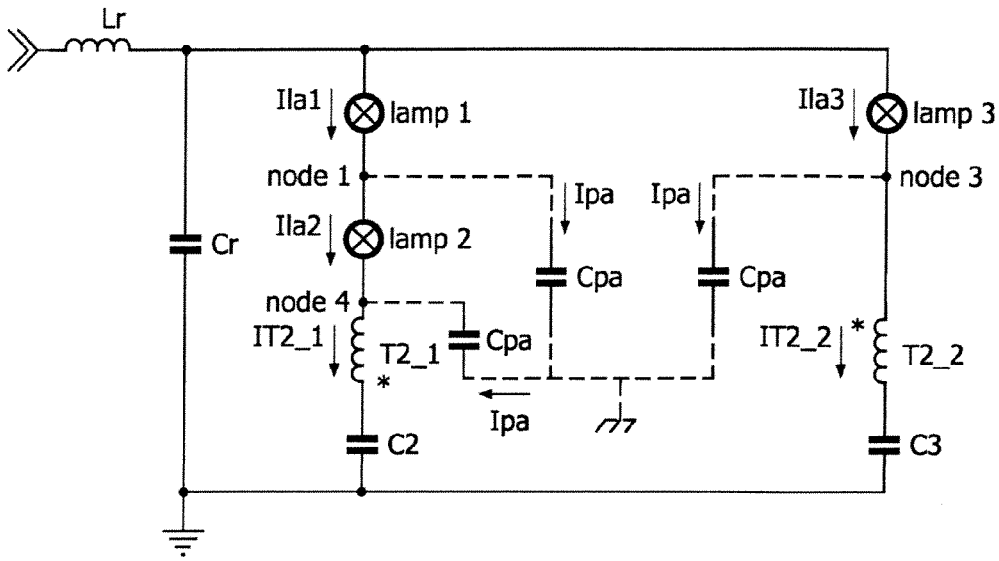
FIG. 3 PRIOR ART
FIG. 3 shows a hybrid series-parallel lamp circuit of a prior art for driving three lamps, and a schematic view of the circuit structure of a number of parasitic circuits of the hybrid series-parallel lamp circuit of the prior art.

Assuming that the turns ratio of T1 in the circuit shown in FIG. 4 is 1:1:1, due to the flux balancing condition, two times the current of the lamps will pass the winding T1_1, while four times the current of the lamps will pass the Lr. In the case of FIG. 5, one time the current of the lamps will pass T1_1, while three times the current of the lamps will pass the Lr. In the circuits shown in FIGS. 2 and 3, only two times the current of the lamps will pass the Lr. If it is desired to avoid that more than two times the current of the lamps passes the Lr, an additional winding may be added to T1. A4 shown in FIG. 6 may be the location of such an additional winding in the circuit. The turns ratio of the inverse transformer T1 and the way of connection of the winding A4 may be designed such that the flux on the winding A4 may counteract the flux on the windings A2 and A3, thus, only magnetizing current is left in the winding A1, making the current passing Lr become two times the lamp current, so that it is identical to the current passing Lr in the prior art.

The inverse transformer T1 may be further optimized, for example, circuit connection E1 may be chosen to combine the windings A2 and A3 in order to save a winding, however, this has the drawback that the loss in the winding will somewhat increase. Table 1 below gives some schemes for circuit connections of the inverse transformer T1, which may be selected in practice.

TABLE 1

| Scheme to be selected | Possible circuit connections | Selection of the locations of the windings of inverse transformer | Turns ratio of the inverse transformer | Current passing the Lr |
|---|---|---|---|---|
| 1 | D1 + D4 + E1 | A1 + A2 | 1:1 | ILr = 4Ila |
| 2 | D1 + D4 + E2 | A1 + A2 + A3 | 1:1:1 | ILr = 4Ila |
| 3 | D1 + D3 + E1 | A1 + A2 + A4 | 2:1:1 | ILr = 2Ila |
| 4 | D1 + D3 + E2 | A1 + A2 + A3 + A4 | 2:1:1:1 | ILr = 2Ila |
| 5 | D2 + D3 + E1 | A1 + A2 + A4 | 1:1:1 | ILr = 2Ila |
| 6 | D2 + D3 + E2 | A1 + A2 + A3 + A4 | 1:1:1:1 | ILr = 2Ila |

For the equalizer transformer T2, different locations may be selected for its windings, as shown in Table 2 below, and when the connection location of B3+B4 is employed, i.e. the two windings are each located in the middle of two series lamps, which are the cold points in the circuit, the balancing effect is optimal. However, there is the drawback that the number of the connecting terminals of the lamps is increased. If other locations are selected, although the number of the connecting terminals of the lamps is reduced, symmetrical lamp wiring is required to obtain an appropriate balancing effect, since these locations are all hot points in the circuit.

TABLE 2

| Scheme to be selected | Selection of the locations of the windings of the equalizer transformer | Balancing Effect |
|---|---|---|
| 1 | B1 + B2 | Symmetrical lamp wiring is required |
| 2 | (B5 or B7) + (B6 or B8) | Symmetrical lamp wiring is required |
| 3 | B3 + B4 | Optimal |

As blocking capacitors, C1-C3 in the circuit are not strictly limited with respect to their locations.

Figure 7:
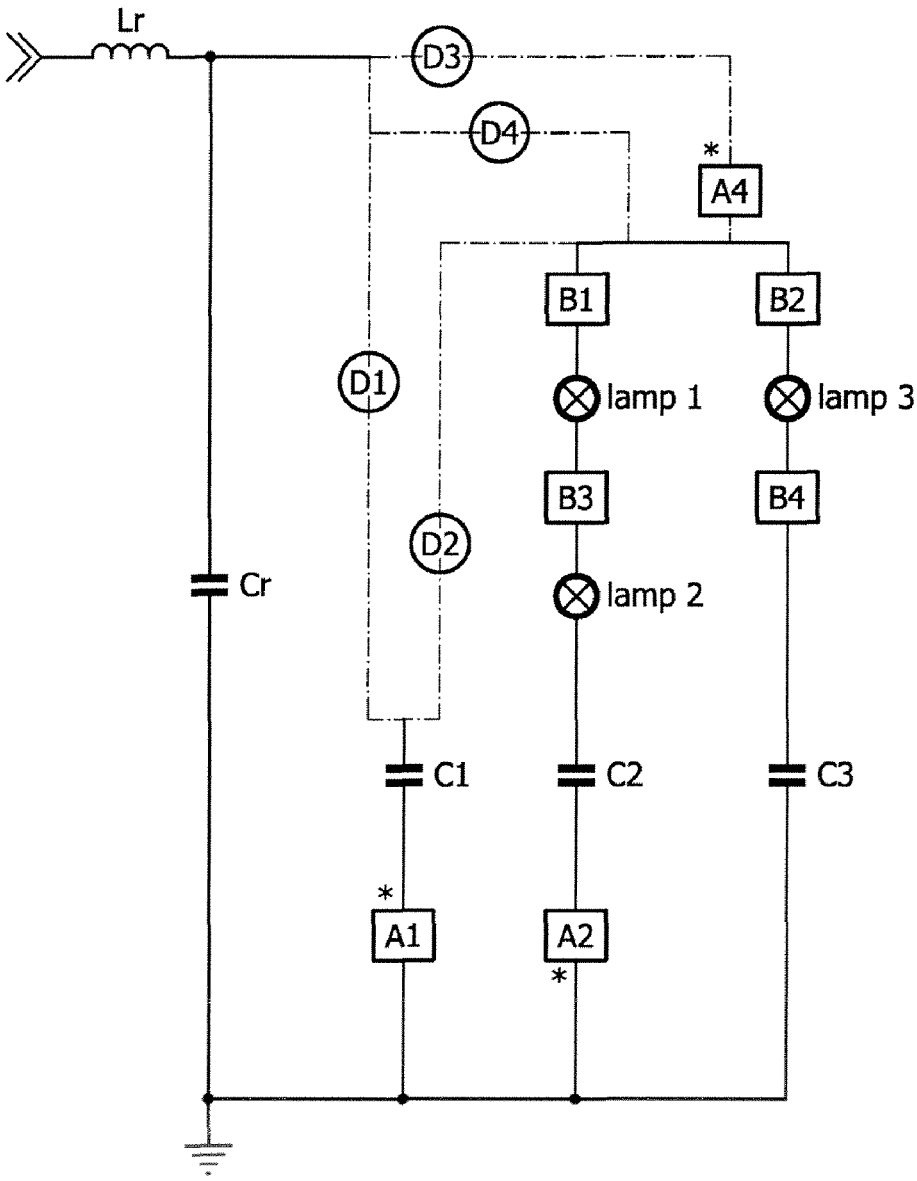
FIG. 7 shows a general structure of a hybrid series-parallel lamp circuit for driving three lamps according to the present invention.

FIG. 6 shows a general structure of a hybrid series-parallel lamp circuit for driving four lamps according to the present invention. With the same principle, when the present invention is used to drive only three lamps, a general structure is shown in FIG. 7. Similar to FIG. 6, different locations may be selected for the windings of the inverse transformer T1 and the equalizer transformer T2 in FIG. 7. Table 3 and Table 4 below give respectively some schemes for winding connections of the inverse transformer T1 and the equalizer transformer T2. The scheme of FIG. 7 will not be explained further, as it is similar to that of FIG. 6.

TABLE 3

| Scheme to be selected | Possible circuit connections | Selection of the locations of the windings of the inverse transformer | Turns ratio of the inverse transformer | Current passing the Lr |
|---|---|---|---|---|
| 1 | D1 + D4 | A1 + A2 | 1:1 | ILr = 3Ila |
| 2 | D1 + D3 | A1 + A2 + A4 | 2:1:1 | ILr = 1.5Ila |
| 3 | D2 + D3 | A1 + A2 + A4 | 1:1:1 | ILr = 1.5Ila |
| 4 | D2 + D3 | A1 + A2 + A4 | 1:1:0.5 | ILr = 2Ila |

TABLE 4

| Scheme to be selected | Selection of the locations of the windings of the equalizer transformer | Balancing Effect |
|---|---|---|
| 1 | B1 + B2 | Symmetrical lamp wiring is required |
| 2 | B3 + B4 | Optimal |

It may be known from the embodiments above that an additional inverse transformer is used in the lamp driving circuit of the present invention to eliminate the parasitic current in the series branch circuit, which makes the current passing each lamp of each series branch circuit consistent and consequently eliminates the imbalance of each lamp.

It should be noted that the embodiments above are exemplary and not to be construed as limiting the present invention, and within the scope of the appended claims, the skilled in the art should understand that various modifications may be made to the lamp driving circuit disclosed in the present invention without departing from the contents of the present invention. Therefore, the scope of the present invention should be defined by the appended claims. Furthermore, any reference number in the claims should not be construed as limiting the scope of the claims.

What is claimed is:

1. A lamp driving circuit for driving more than two lamps, wherein the lamps are located in at least two branch circuits connected in parallel and at least one of the branch circuits comprises at least two lamps connected in series, the lamp driving circuit comprising:

an equalizer transformer comprising at least two windings each connected in series to one of the at least two branch circuits connected in parallel; and an inverse transformer connected to the at least two branch circuits connected in parallel, for eliminating the parasitic current in each branch circuit.

2. The lamp driving circuit according to claim 1, wherein the inverse transformer comprises a first winding connected in parallel to the at least two branch circuits connected in parallel.

3. The lamp driving circuit according to claim 2, wherein the inverse transformer further comprises a second winding connected in series to the at least two branch circuits connected in parallel.

4. The lamp driving circuit according to claim 2, wherein the inverse transformer further comprises a plurality of second windings each connected in series to one of those branch circuits that comprise at least two lamps.

5. The lamp driving circuit according to claim 3, wherein the inverse transformer further comprises a third winding connected in series to the at least two branch circuits connected in parallel and designed such that its flux counteracts the flux of the second winding(s) of the inverse transformer.

6. An electronic ballast for driving more than two lamps, wherein the lamps are located in at least two branch circuits connected in parallel and at least one of the branch circuits comprises at least two lamps connected in series, the electronic ballast comprising:

a half-bridge circuit; and a driving circuit connected to the half-bridge circuit, the driving circuit comprising an inverse transformer connected to the at least two branch circuits connected in parallel, for eliminating the parasitic current in each branch circuit.

7. The electronic ballast according to claim 6, wherein the driving circuit further comprises a equalizer transformer, the equalizer transformer comprising at least two windings each connected in series to one of the at least two branch circuits connected in parallel.

8. The electronic ballast according to claim 7, wherein the inverse transformer comprises a first winding connected in parallel to the at least two branch circuits connected in parallel.

9. The electronic ballast according to claim 8, wherein the inverse transformer further comprises a second winding connected in series to the at least two branch circuits connected in parallel.

10. The electronic ballast according to claim 8, wherein the inverse transformer further comprises a plurality of second windings, each connected in series to one of those branch circuits that comprise at least two lamps.

11. A lighting circuit comprising:

more than two lamps, wherein the lamps are located in at least two branch circuits connected in parallel and at least one of the branch circuits comprises at least two lamps connected in series; and a driving circuit for driving the lamps, the driving circuit comprising an inverse transformer connected to the at least two branch circuits connected in parallel, for eliminating the parasitic current in each branch circuit.

12. The lighting circuit according to claim 10, wherein the inverse transformer comprises a first winding connected in parallel to the at least two branch circuits connected in parallel.

13. The electronic ballast according to claim 12, wherein the transformer further comprises a second winding connected in series to the at least two branch circuits connected in parallel.

14. The electronic ballast according to claim 12, wherein the inverse transformer further comprises a plurality of second windings, each connected in series to one of those branch circuits that comprise at least two lamps.

* * * * *